US005598068A

United States Patent [19]

Shirai

[11] Patent Number: 5,598,068

[45] Date of Patent: Jan. 28, 1997

[54] LIGHT EMITTING APPARATUS COMPRISING MULTIPLE GROUPS OF LEDS EACH CONTAINING MULTIPLE LEDS

[75] Inventor: Kiyokazu Shirai, Kawasaki, Japan

[73] Assignee: Sony/Tektronix Corporation, Tokyo, Japan

[21] Appl. No.: 401,519

[22] Filed: Mar. 10, 1995

[30] Foreign Application Priority Data

Mar. 18, 1994 [JP] Japan ..... 6-073904

[51] Int. Cl.[6] ..... H05B 43/00

[52] U.S. Cl. ..... 315/185 R; 315/160; 315/363; 361/23; 361/27; 361/800; 340/825.82; 345/82; 345/212; 345/134; 345/905

[58] Field of Search ..... 345/80, 82, 211, 345/212, 905, 23, 24, 10, 11, 134, 39; 315/169.1, 309, 363, 185 R, 160, 161, 129; 362/27, 23, 800; 340/825.79, 825.82

[56] References Cited

U.S. PATENT DOCUMENTS 4,329,625 5/1982 Nishizawa et al. ..... 315/158
5,012,162 4/1991 Chun ..... 315/309

*Primary Examiner*—Robert Pascal
*Assistant Examiner*—Arnold Kinkead
*Attorney, Agent, or Firm*—Smith-Hill and Bedell

[57] ABSTRACT

A plurality of LEDs are divided into multiple groups with the LEDs in each group being connected in series and being driven by a single current source. A region to be illuminated is divided into many areas with no spacing between adjacent ones of the areas. The LEDs in each group are positioned in different areas such that each area includes many LEDs from different groups. If one of the current sources and/or one of the LEDs of one group breaks down, the broken current source and/or LED does not affect the current sources and/or LEDs of the other groups.

14 Claims, 3 Drawing Sheets

LIGHT EMITTING APPARATUS COMPRISING MULTIPLE GROUPS OF LEDS EACH CONTAINING MULTIPLE LEDS

BACKGROUND OF THE INVENTION

The present invention relates to illumination devices, and more particularly to a light emitting apparatus having a plurality of light emitting diodes for illuminating a region such as an instrument panel.

In electronic measurement instruments, such as oscilloscopes, television waveform monitors, vectorscopes and the like, a waveform and/or a vector of an input signal is displayed on a screen of a cathode ray tube (CRT). Many kinds of graticules or scales are provided on the inside or outside of the CRT faceplate in order to assist an operator in the observation of the displayed waveform or vector. Such a graticule pattern may be a grid pattern or any desired pattern representative of an allowable range for the waveform or the vector. An illumination device is used to light the graticule pattern so that the operator may measure the input signal with the graticule in a darkened room. Such illumination devices are used in other fields, for example, as brake indicating lamps for automobiles.

In illumination devices for a CRT graticule or a brake lamp, high intensity is desired and there should provision for malfunction of the devices. A conventional illuminating device uses an incandescent lamp and a colored glass or a semitransparent colored plastic to emit the colored light therefrom. Since the lifetime of an incandescent lamp is limited, there is a high possibility that the filament of the lamp will open suddenly. It is troublesome to replace the broken lamp with a new lamp every time the lamp breaks. In brake lamps for an automobile, it may be dangerous if the lamp breaks down suddenly.

Recently light emitting diodes (LEDs) have been used instead of an incandescent lamp because LED lifetime is longer than incandescent lamps and LED intensity levels have been improved. Therefore LEDs may be used to overcome the above discussed disadvantages. However the intensity of a single LED is not enough to illuminate the CRT graticule or indicate brake condition. A plurality of LEDs are necessary to equal the intensity level of a single incandescent lamp.

When LEDs are used for illumination devices, a current source applies a current to each LED. For a simple circuit configuration, all the LEDs are connected in series and this series circuit receives the current from a single current source. As described above the lifetime of an LED is longer than that of an incandescent lamp. However LED lifetime is not infinite and it may break down under many different conditions. When at least one LED breaks down in the series circuit, all the LEDs stop emitting light. Thus, this does not satisfy maintenance and safety requirements.

If all the LEDs are connected in parallel and receive the current from a single current source, the luminance levels of the LEDs are different from each other because of the different characteristics of the LEDs which cause the currents flowing through the LEDs to be different from each other. Thus, this configuration does not emit a uniform light. In addition, if any one of the LEDs becomes shorted, the current from the current source flows through only the shorted LED and the other LEDs do not emit light. However if each of the LEDs has its own current source, the circuit configuration becomes expensive and complex.

Additionally an LED is sensitive to temperature and LED lifetime may be reduced if a high current flows through it at a high temperature. Therefore the current flowing through the LED should be within a forward current derating curve of the LED, i.e., a characteristic curve of the available current at each temperature for the LED.

What is desired is a light emitting apparatus that includes a plurality of LEDs and reduces the number of current sources configured so that a broken LED and/or current source does not affect other LEDs and/or current sources. Also adjustment of the current flowing through the LEDs as a function of temperature is desired to prolong the LED lifetime.

SUMMARY OF THE INVENTION

Accordingly the present invention provides a light emitting apparatus having many LEDs divided into groups with the LEDs in each group being connected in series and being driven by a single current source. A region to be illuminated is divided into several areas with no spacing between adjacent areas. The LEDs in each group are positioned in different ones of the areas such that each area includes many LEDs from different groups. If one current source and/or one LED of one group breaks down, the broken current source and/or LED does not affect the LED operation of the other groups.

Each of M LED groups has N LEDs connected in series, M and N being positive integers larger than one, and each of M current sources supplies a current to each of the respective M LED groups. A bias circuit applies a control bias to each of the M current sources in order to control the current applied by each current source. The total number of LEDs is N×M and they are arranged or positioned in N areas so that each area includes one LED from each LED group with no spacing between adjacent areas. Because one LED of each group is positioned in each area, if one LED from one group breaks down, the intensity level for each area is reduced only slightly. If each area includes at least two LEDs from the same LED group, where the number of areas is less than or equal to N/2, then the LEDs of the same LED group are not positioned adjacent to each other in each area.

Each current source has a transistor with a collector connected to one LED group, or the series circuit of the LEDs, with an emitter connected through a first resistor to a first voltage level source, and a base connected through a second resistor to a second voltage level source. The current source further includes a diode between the base of the transistor and the bias circuit. If the base-emitter junction of the transistor in any current source is shorted out and the current source malfunctions, or if an LED is opened, the diode of the current source is reverse biased so only the broken current source is separated from the bias circuit in order to prevent the other current sources from being affected by the broken current source. If the current source breaks down because of the usual off state of the transistor, this broken current source also does not effect the bias circuit.

The bias circuit includes a temperature sensor, such as a thermistor, which is physically situated adjacent to the LEDs. When the sensor detects a rise in temperature, it adjusts the control bias to reduce the current applied from the current sources. Thus, the current applied to the LEDs is adjusted to be equal to or less than the current determined by the forward current derating curve characteristic of the LED. As a result LED lifetime is extended.

The objects, advantages and novel features of the present invention are apparent from the following detailed description when read in conjunction with the appended claims and attached drawing.

DETAILED DESCRIPTION OF THE INVENTION

Figure 2:
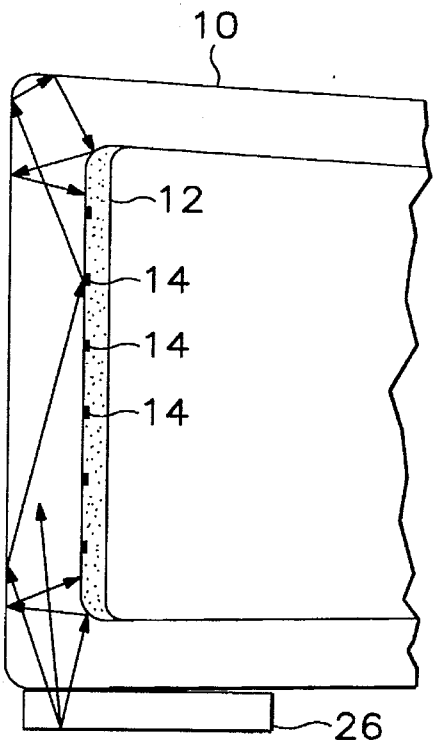
FIG. 2 is a cross-sectional side view of a portion of the assembled CRT display system of FIG. 1.
Figure 1:
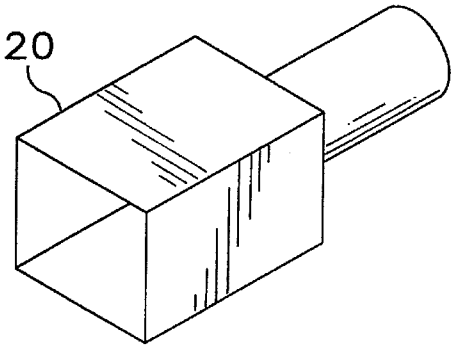
FIG. 1 is an exploded perspective view of a CRT display system using a light emitting apparatus according to the present invention as an illumination device for a CRT graticule.
Figure 1:
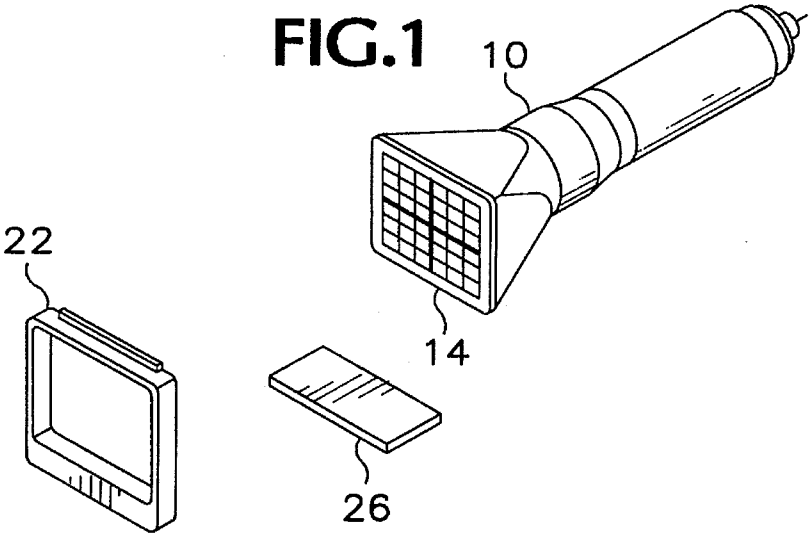

Referring now to FIGS. 1 and 2, there are shown an exploded perspective view and a cross-sectional side view of a CRT display system using a light emitting apparatus 26 for illuminating a graticule 14. In FIG. 2 slanted lines are not drawn in sections in order to simplify the drawing. A CRT 10 is inserted into a shield case 20 and is fixed to a body of an electronic measurement instrument (not shown) by mounting a bezel 22 to the body. The graticule or scale 14 and a phosphor 12 are provided on the inside of the CRT faceplate in this embodiment. The phosphor 12 radiates to form a waveform image when the phosphor is bombarded by an electron beam deflected by a signal to be measured, as is well known in the art. The scale 14 is useful for measuring the displayed waveform image.

The light emitting apparatus 26 is positioned at the bottom of the CRT 10 and fixed to the instrument body in order to illuminate the scale 14. The light emitting apparatus 26 may be positioned alternatively at the upper or side portion of the CRT 10, at both of the upper and bottom portions, or at both side portions thereof. The configuration of the light emitting apparatus 26 is discussed in detail below. The light emitting apparatus 26 emits light which transfers through the faceplate or the transparent glass and is reflected by both side surfaces of the faceplate to illuminate the scale 14.

Figure 3:
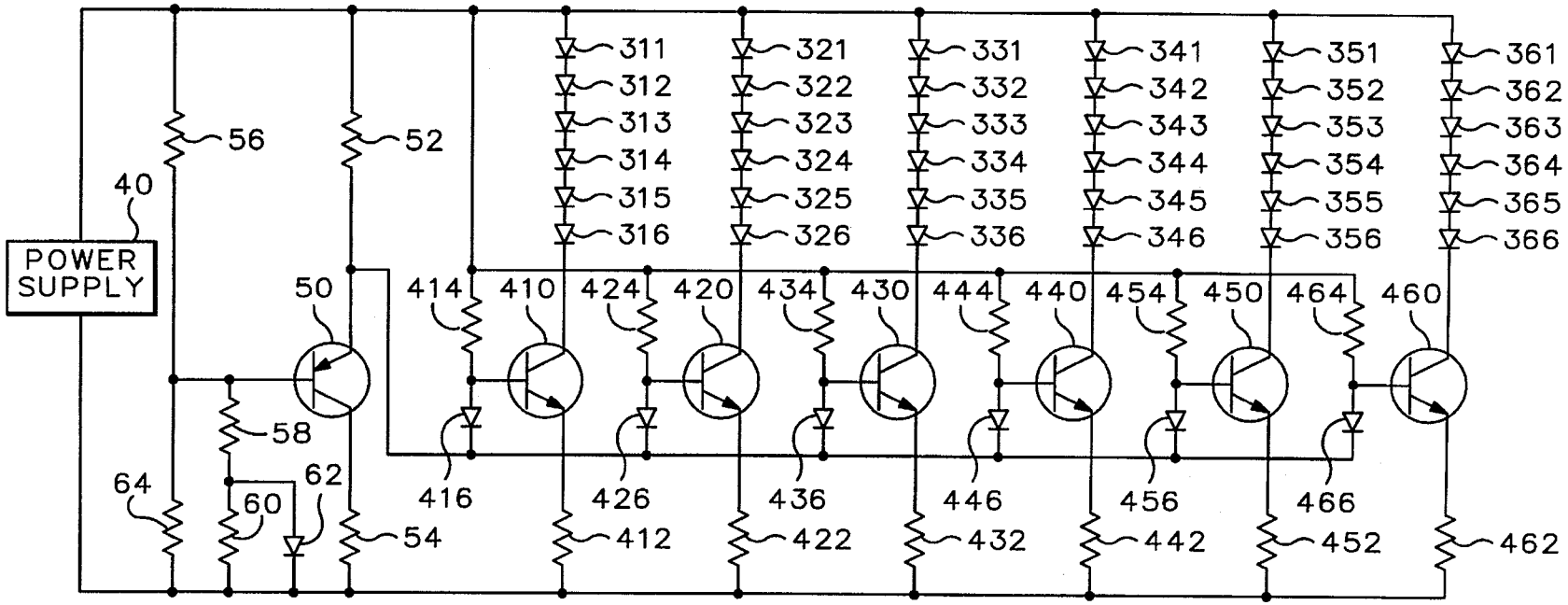
FIG. 3 a circuit schematic of a light emitting apparatus according to the present invention.

FIG. 3 shows a circuit schematic of the light emitting apparatus 26. For illustrational purposes thirty-six LEDs 311–366 are shown divided into M LED pups, M=6, with each group having N LEDs, N=6. In other words, LEDs 311–316 are connected in series and assigned to the first LED group, LEDs 321–326 are connected in series and assigned to the second LED group, LEDs 331–336 are connected in series and assigned to the third LED group, LEDs 341–346 are connected in series and assigned to the fourth LED group, LEDs 351–356 are connected in series and assigned to the fifth LED group, and LEDs 361–366 are connected in series and assigned to the sixth LED group. In the reference numbers of the LEDs, the second least significant digit represents the LED group and the least significant digit represents the LED position area. The anodes of the highest positioned LEDs in all the LED groups are connected to one terminal of a power supply or voltage source 40 that operates as a second voltage level source.

The cathodes of the lowest positioned LEDs of all the groups are connected to respective current sources 410–466. The current sources include NPN transistors 410–460 respectively with the collectors of the current source transistors being connected to the cathodes of the lowest positioned LEDs 316–366. The emitters of the current source transistors 410–460 are connected to the other terminal of the power supply 40 or a first voltage level source through respective resistors 412–462, each having a 47-ohm resistance. The bases of the NPN transistors 410–460 are connected to the one terminal of the power supply 40 as the second voltage level source through respective resistors 414–464, each having a 47 Kilo-ohm resistance, and also are connected to the anodes of respective diodes 416–466. The PN junctions of the diodes 416–466 conduct current in the same direction, relative to the base of the respective transistors 410–460, as the base emitter junctions of the transistors, i.e. away from the base. The number of the current sources is equal to that of the LED groups because each LED group has a single series circuit of LEDs.

A bias circuit has a PNP transistor 50 with an emitter connected to the one terminal of the power supply 40 via a 10 Kilo-ohm resistor 52, and with a collector connected to the other terminal of the power supply through a 100 ohm resistor 54. A voltage divider has a 100 Kilo-ohm resistor 56, a 1.2 Kilo-ohm resistor 58, a 5.6 Kilo-ohm resistor 60, a diode 62 and a thermistor 64 as a temperature sensor. This voltage divider divides the voltage across the voltage source or the power supply 40 and applies the divided voltage to the base of transistor 50.

Figure 4:
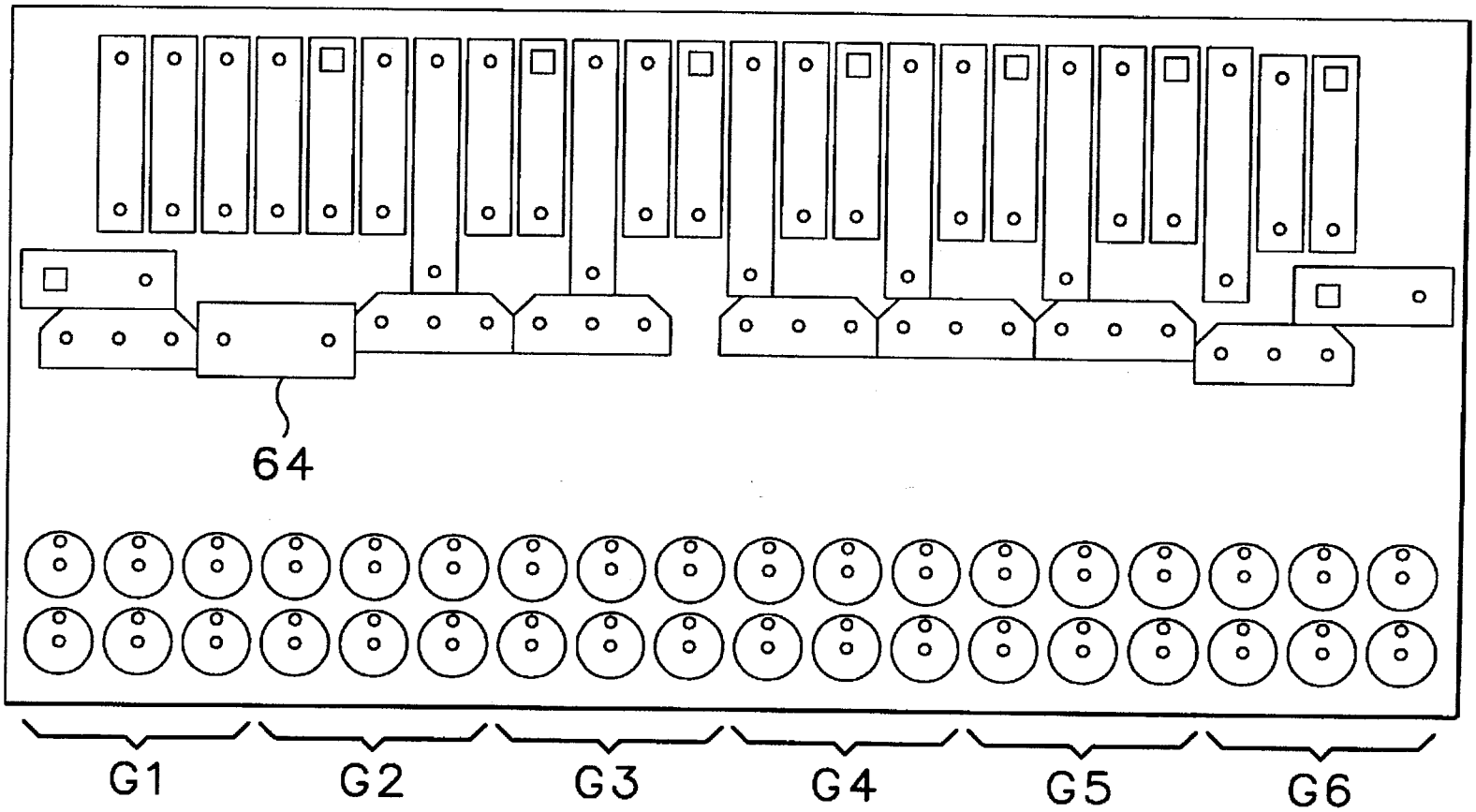
FIG. 4 is a top plan view of a printed circuit board for a light emitting apparatus according to the present invention.

FIG. 4 shows a printed circuit board on which the elements of FIG. 3 are mounted. Circles on two lowest rows of the circuit board represent the LEDs 311–366. These LEDs are divided into N areas each having M LEDs, as described above, and there is no spacing between adjacent areas. In other words, the first area G1 includes the LEDs 311=14 361 that are arranged continuously as a 2×3 matrix, the second area G2 includes the LEDs 312–362 arranged as the 2×3 matrix, etc. The LEDs in the same LED group are not neighbors on the circuit board. The thermistor 64 is positioned adjacent to the LEDs to detect an environmental temperature for the LEDs. The other elements are mounted at appropriate positions of the printed circuit board. The printed circuit board is mounted adjacent to the CRT 10 such that the LEDs face the CRT as shown in FIGS. 1 and 2.

In operation the voltage divider 56–64 provides divided voltage to the base of the bias transistor 50 and the emitter voltage thereof is determined by adding the base-emitter voltage to the base voltage. The emitter voltage is applied to the bases of the current source transistors 410–460 via respective diodes 416–466. The resistors 414–464 turn on these diodes. In the current sources, the currents supplied to the LED groups are determined by the base voltages of the current source transistors 410–460, the values of the resistors 412–462 and the opposite terminal voltage of the power supply 40. The LEDs emit light as a function of the currents flowing therethrough. In order to adjust the intensity of the LEDs, the output voltage of the power supply 40 is varied. If the power supply 40 generates a pulse voltage, the duty factor and/or amplitude of the pulse may be changed.

If one of LEDs 311–366 breaks down and all the LEDs of the group including the broken LED stop emitting light, only one LED of each divided area does not radiate because each LED of the broken LED group is distributed over each LED area. Since each LED area includes many LEDs each assigned to a different LED group, the total intensity of the LEDs in each area reduces only slightly when one LED of each area does not radiate. In other words, the LEDs of the broken group are assigned to each area so that the intensity level of a specified area does not reduce significantly. Thus, irregular illumination does not occur if an LED breaks down.

When the base-emitter junction of one of the current source transistors 410–460 is shorted and the current source breaks down and/or when any LED in a group is opened, this phenomenon reduces the base voltage of the broken current source transistor and/or the base voltage of the transistor for applying the current to the broken LED group. As a result, the diode 416–466 connected to such a base is reverse biased and is turned off and the subject transistor is separated from the bias circuit. The affected transistor does not impact the bias circuit and the other current sources, so that only the LEDs of the group connected to the broken current source do not emit light. In this instance, uneven intensity from the light emitting apparatus is limited. Further if the base-emitter junction of any current source transistor 410–460 is turned off continuously for some reason, such transistor does not affect the bias circuit and only the LED group connected to the broken transistor does not radiate.

When the environmental temperature of the LEDs rises, the resistance of the thermistor 64 reduces and the bias voltage produced by the bias circuit decreases. Then the current from each current source decreases and overcurrent does not flow through the LEDs. Thus, the lifetime of the LEDs may be extended. The reduced current value is determined to satisfy the forward current derating curve characteristic.

As can be understood from the foregoing description, the light emitting apparatus reduces the number of the current sources while using a plurality of LEDs. If any LED breaks down, the LED groups excluding the broken LED are not affected by the broken LED group. In addition the bias circuit may adjust the current flowing through the LEDs properly in accordance with the environmental temperature.

While a preferred embodiment of the invention is described above, it is apparent to those skilled in the art that many changes and modifications may be made without departing from the invention in its broader aspects. For example, the numbers of the total LEDs (M) and the LED groups (N) may be any desired positive integers larger than one. The temperature sensor may be a thermocouple device or a P-N junction of a semiconductor. Any desired LED arrangement may be applied to each area. The light emitting apparatus of the invention may be applied for any illumination devices including an automobile brake indicator lamp and the like. In addition each area may include at least two LEDs of the same LED group if each LED group includes LEDs whose number is larger that of the number of areas. Therefore, the scope of the present invention should be determined only by the following claims.

What is claimed is:

1. An electronic instrument including a cathode ray tube having a faceplate provided with a graticule and an illumination device for illuminating the graticule, the illumination device comprising:

a support member defining a plurality of discrete positioning areas, said discrete positioning areas being arranged adjacent to each other without any intervening spacing;

a plurality of light emitting diode groups, each group having a plurality of light emitting diodes connected in series, the light emitting diodes being mounted on the support member such that one light emitting diode of each light emitting diode group is positioned in each of said discrete positioning areas;

a plurality of current sources equal in number to the plurality of light emitting diode groups, each current source coupled to respective ones of the light emitting diode groups for applying currents to a each of the light emitting diode groups; and a bias circuit coupled to each current source for supplying a control bias to the current sources to control the current applied by the current sources to the light emitting diode groups, and wherein the support member is positioned adjacent an edge of the faceplate such that the plurality of discrete positioning areas are disposed along said edge of the faceplate.

2. An electronic instrument comprising a cathode ray tube having a faceplate provided with a graticule and an illumination device illuminating the graticule by emitting light from a plurality of light emitting diodes, said illumination device comprising:

a support member defining N discrete positioning areas, N being a positive integer larger than one, said discrete positioning areas being arranged adjacent to each other without any intervening spacing;

M light emitting diodes groups, each group having N light emitting diodes connected in series, M being a positive integer larger than one, the light emitting diodes being mounted on the support member such that one light emitting diode of each light emitting diode group is positioned in each of said N discrete positioning areas;

M current sources, each current source being coupled for applying currents to a corresponding one of the M light emitting diode groups, and wherein the support member is positioned adjacent an edge of the faceplate such that the plurality of discrete positioning areas are disposed along said edge of the faceplate.

3. The electronic instrument as recited in claim 2, wherein the illumination device further comprises a bias circuit coupled to each current source for supplying a control bias to the M current sources to control the current applied by the M current sources to the light emitting diode groups and wherein each current source comprises a transistor having a collector connected to one of the light emitting diode groups, an emitter connected to a first voltage level source through a first resistor and a base connected to a second voltage level source through a second resistor; and a diode connected between the base of the transistor and the bias circuit.

4. The electronic instrument as recited in claim 2, wherein the illumination device further comprises a bias circuit coupled to each current source for supplying a control bias to the M current sources to control the current applied by the M current sources to the light emitting diode groups and wherein the bias circuit comprises a temperature sensor physically situated adjacent to the light emitting diodes, the temperature sensor being coupled to control the control bias to reduce the current applied by the current sources when the temperature sensor detects a rise in temperature.

5. The electronic instrument as recited in claim 4, wherein the temperature sensor comprises a thermistor.

6. The electronic instrument as recited in claim 2, wherein the illumination device further comprises a bias circuit coupled to each current source for supplying a control bias to the M current sources to control the current applied by the M current sources to the light emitting diode groups and wherein the bias circuit comprises:

a transistor having an emitter coupled to a first voltage level source and providing the control bias, a collector coupled to a second voltage level source, and a base; and a voltage divider coupled between the first and second voltage level sources and having a tap coupled to the base.

7. The electronic instrument as recited in claim 6, wherein the voltage divider comprises:

a first resistor coupled between the base and the first voltage level source; and a temperature sensitive resistance element coupled between the base and the second voltage level source.

8. The electronic instrument as recited in claim 2, wherein the illumination device further comprises a bias circuit coupled to each current source for supplying a control bias to the M current sources to control the current applied by the M current sources to the light emitting diode groups and wherein each current source comprises:

a transistor having a collector connected to one of the light emitting diode groups, an emitter connected to a first voltage level source through a first resistor, and a base connected to a second voltage level source through a second resistor, the transistor having a base emitter junction; and a diode connected between the base of the transistor and the bias circuit, the diode having a PN junction that conducts current in same direction relative to the base of the transistor as the base emitter junction of the transistor.

9. An electronic instrument including a cathode ray tube having a faceplate provided with a graticule, and an illumination device for illuminating the graticule, said illumination device comprising:

a plurality of light emitting diode groups, each group having a plurality of light emitting diodes connected in series;

a plurality of current sources equal in number to the plurality of light emitting diode groups, each current source coupled to respective ones of the light emitting diode groups for applying current to each of said light emitting diode groups; and a bias circuit coupled to each current source for supplying a control bias to said current sources to control the current applied by the current sources to the light emitting diode groups;

the plurality of light emitting diodes being positioned in each of a plurality of discrete positioning areas along an edge of the faceplate such that each of said discrete positioning areas includes at least one light emitting diode for each of the light emitting diode groups, and the discrete positioning areas being arranged adjacent to each other without any intervening spacing.

10. An electronic instrument according to claim 9, wherein the illumination device comprises a circuit board defining said plurality of discrete positioning areas, and the light emitting diodes are mounted on the circuit board such that one light emitting diode of each light emitting diode group is positioned in each of said discrete positioning areas.

11. The electronic instrument as recited in claim 9, wherein each current source comprises:

a transistor having a collector connected to one of the light emitting diode groups, an emitter connected to a first voltage level source through a first resistor, and a base connected to a second voltage level source through a second resistor; and a diode connected between the base of the transistor and the bias circuit.

12. The electronic instrument as recited in claim 11, wherein the bias circuit comprises:

a transistor having a collector coupled to said first voltage level source, an emitter connected to the diodes of the current sources, and a base; and a voltage divider coupled between the first and second voltage level sources and having a tap coupled to the base of the bias circuit transistor.

13. The electronic instrument as recited in claim 9, wherein each current source comprises:

a transistor having a collector connected to one of the light emitting diode groups, an emitter connected to a first voltage level source through a first resistor, and a base connected to a second voltage level source through a second resistor; and a diode connected between the base of the transistor and the bias circuit, the bias circuit comprises:

a transistor having a collector coupled to said first voltage level source, an emitter connected to the diodes of the current sources, and a base; and a voltage divider coupled between the first and second voltage level sources and having a tap coupled to the base of the bias circuit transistor, and the voltage divider comprises:

a first resistor coupled between the base of the bias circuit transistor and the second voltage level source; and a temperature sensitive element coupled between the base of the bias circuit transistor and the first voltage level source.

14. The electronic instrument as recited in claim 9, wherein each current source comprises:

a transistor having a collector connected to one of the light emitting diode groups, an emitter connected to a first voltage level source through a first resistor, and a base connected to a second voltage level source through a second resistor, the transistor having a base emitter junction; and a diode connected between the base of the transistor and the bias circuit, the diode having a PN junction that conducts current in same direction relative to the base of the transistor as the base emitter junction of the transistor.

* * * * *